United States Patent [19]

Pirrello et al.

[11] Patent Number: 4,895,088

[45] Date of Patent: Jan. 23, 1990

[54] ACCURATE CUTTER SYSTEM FOR SEWING MACHINE

[75] Inventors: Angelo M. Pirrello, Kearney; Philip M. Roth, Wallington, both of N.J.

[73] Assignee: Clinton Industries, Inc., Carlstadt, N.J.

[21] Appl. No.: 201,089

[22] Filed: Jun. 1, 1988

[51] Int. Cl.[4] ..... D05B 37/04

[52] U.S. Cl. ..... 112/130

[58] Field of Search ..... 112/130, 121.11, 121.27, 112/152, 104, 275, 277, 288, 272

[56] References Cited

U.S. PATENT DOCUMENTS

| | | | |
|---|---|---|---|
| 4,335,666 | 6/1982 | Schwaab et al. | 112/130 |
| 4,438,714 | 3/1984 | Smith et al. | 112/130 |
| 4,545,314 | 10/1985 | Fujikawa | 112/275 |
| 4,548,143 | 10/1985 | Martell et al. | 112/121.11 |
| 4,589,363 | 5/1986 | Willenbacher et al. | 112/275 X |
| 4,607,583 | 8/1986 | Biermann et al. | 112/130 |

*Primary Examiner*—Peter Nerbun

*Attorney, Agent, or Firm*—Darby & Darby

[57] ABSTRACT

A sewing machine having a reciprocatable needle for stitching material thereunder, a motor driven handwheel for cutting thread or material in the vicinity of the needle within a finite time interval from when actuated and a controller for actuating the cutter at leading and trailing ends of the material. The sewing machine applies a stitch to the material during one complete revolution of the handwheel. The controller comprises a sensor, disposed a given distance from the cutter, for sensing the leading edge and the trailing edge of material under the needle. The number of revolutions of the handwheel is counted after the leading edge is sensed or after the trailing edge is sensed. The stitching speed is sensed, a first reference is provided for indicating the desired number of stitches to be applied in the given distance and a second reference is provided for indicating the finite time interval. Stitches are subtracted from the desired number in dependence upon the sensed stitching speed and the finite time interval. The cutter is actuated when the counted number of revolutions is equal to the desired number of the stitches less the subtracted number of stitches.

7 Claims, 3 Drawing Sheets

ACCURATE CUTTER SYSTEM FOR SEWING MACHINE

BACKGROUND OF THE INVENTION

The present invention relates to a system for accurately controlling a cutter for cutting a thread chain or binding on a sewing machine.

In the garment industry, garments are finished by applying a binding to the edge of the garment and sewing it in place or by applying an overedge stitch referred to in the art as a thread chain. After the garment passes beyond the needle, the stitches continue to be applied to the edge of the garment to attach the binding or to form the thread chain. At some point, depending on the manner in which the garment is finished, a cutter must sever the binding and the stitches from the portion sewn to the garment or the thread chain from the edge of the garment.

An important requirement of any cutting system is that the length of the thread chain or the binding that remains attached to the fabric, after cutting, be uniform and independent of machine speed and cutter reaction time.

In the prior art, stitch counting is used to control the operation of the cutter. The prior art uses an electric eye which senses the presence or absence of the fabric material. After the fabric passes a distance beyond the electric eye, and the requisite number of stitches are sewn, the cutter is triggered. As can be appreciated, since it takes a finite time for the cutter to react and a time interval elapses for the edge of the material to pass from the electric eye to the cutter, the triggering of the cutter must be properly timed so that the binding or the thread chain is cut at the edge of the material. While, such prior art systems can be adequately set to cut the binding or thread chain for a given sewing machine speed, if the speed of the machine increases, the cutter may react too slowly and cut through the material. This results from the fact that more stitches will be sewn during the cutter reaction time for a faster machine speed.

SUMMARY OF THE INVENTION

As will be discussed in greater detail hereinafter, the present invention provides an improved means for controlling the actuation of the cutter at the leading or the trailing edges of the material. The sewing machine has a reciprocating needle for stitching material thereunder and a motor driven handwheel for reciprocating the needle. The sewing machine applies one stitch to the material during a single complete revolution of the handwheel. An actuatable cutting means is provided for cutting the thread or material in the vicinity of the needle within a finite time interval after being triggered. Means are provided for controlling the actuation of the cutting means. The present invention advantageously utilizes the fact that a sewing machine applies one stitch to the material during a single complete revolution of the handwheel.

In the improved controlling means of the present invention, sensing means are provided for sensing an edge of the material. Such means are disposed at a preselected distance from the cutting means. First reference means are provided for producing a first signal indicating a desired number of stitches that can be applied within the preselected distance. Second reference means are provided for producing a second signal indicating the finite time interval that the cutting means takes to operate. Counting means, responsive to the sensing means, are provided for counting the number of revolutions that the handwheel makes after the edge of the material is sensed. Stitch means are also provided for sensing the stitching speed and for producing a stitch signal indicating the stitching speed. Means, that are responsive to the second and stitch signals are provided for generating a compensation signal representing a compensated number of stitches that can be applied as a function of the stitching speed and the finite interval. Compensation difference means, responsive to the first and compensation signals, are provided for subtracting the compensated number of stitches from the desired number of stitches. Lastly, actuation means, responsive to the counting means and the compensation difference means, are provided for actuating the cutting means when the counted number of revolutions is equal to the difference between desired number of stitches and the compensated number of stitches. During the operation of the cutting means, the sewing machine continues to stitch the material. However, since the time remaining, after actuation, for the remaining stitches to be sewn is thus equal to the cutter reaction time, the cutting means will cut the thread chain or the binding at the edge of the material or garment being sewn.

When stitch counting is used to actuate the cutter and the leading or trailing edge of the material is sensed, the needle could be at any position between a fully up position, over the material, and a fully down position, penetrating the material. The machine thereafter may rotate anywhere from a fraction of a degree up to a full revolution before stitch counts are registered. This can cause up to a one stitch error in the final count and thus in an improperly timed cut of the binding or thread chain. As stated previously, the sewing machine applies a stitch in one complete revolution of the handwheel. The present invention, by counting revolutions of the handwheel to actuate the cutting means, insures a proper synchronization of cutting with the edge of the material that is independent of needle position when the edge of the material is sensed.

These and other objects and advantages of the present invention will become apparent from the following detailed description of the invention taken with the attached drawings, wherein:

DETAILED DESCRIPTION OF THE INVENTION

Figure 1:
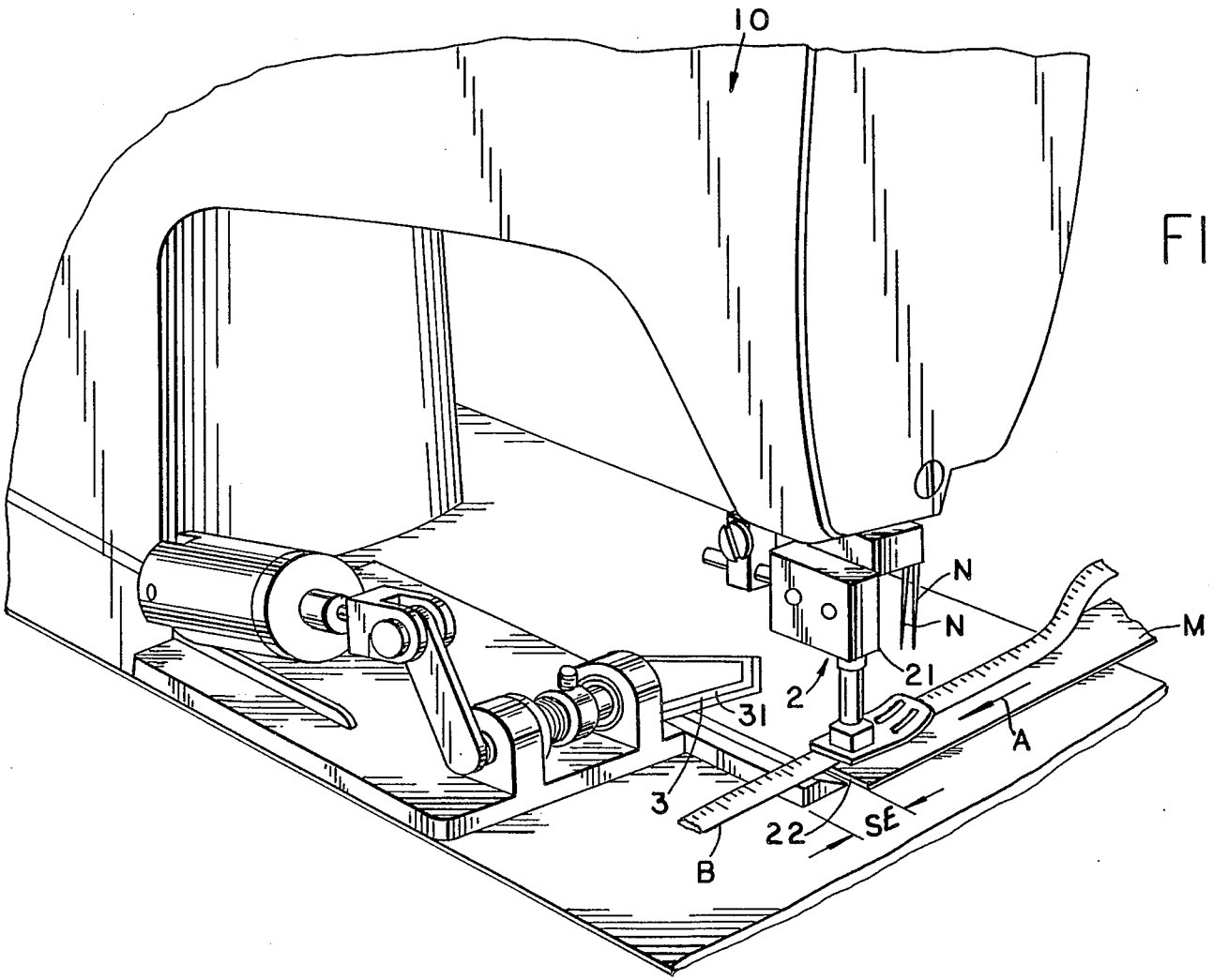
FIG. 1 is a partial view of a sewing machine utilizing the system according to the present invention.

FIG. 1 shows the sewing machine 10 according to the present invention having a cutter assembly 3 at the rear thereof and including cutting blade 31 disposed a distance SE from photocell 21 and retroreflective tape 22 which make up the electric eye assembly 2. The electric eye 2 and cutter blade 31 are disposed down stream of needles N which sew binding material B onto material M. That is, the binding travels in the direction indicated by the arrowhead A.

Figure 4:
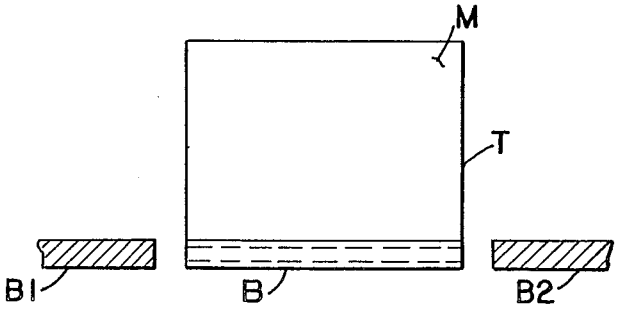
FIG. 4 illustrates the material with cut bindings as carried out by the system according to the present invention.

Referring to FIG. 4, it is desired to attach the binding B to the material M and cut the binding at the leading edge L of material M in a first cut to form cut binding B1 and to cut the binding at the trailing edge T of material M in a second cut to form a cut binding segment B2. It is desired to cut the binding so that it is flush with the leading and trailing edges of the material as is shown in FIG. 4.

The sewing machine 10 includes a handwheel 11 (FIG. 3) having a synchronizer 4 connected thereto and including a first disc 41 which has a single notch thereon and oriented so as to indicate the needles N in the down position and generate a needle down pulse when read by photocell 43. A second disc 42 has a plurality of markings thereon and in this embodiment 240 markings or openings are spaced around the 360° angle thereof so as to produce 240 timing pulses per revolution when also read by the photocell 43. The discs are connected to the drive shaft of the machine. The pulses created by photocell 43 are sent along lead 44 to a microprocessor 1 (FIG. 2) which reads both the needle down pulses and the timing pulses from discs 41 and 42 respectively for carrying out the cutting operation as will be described hereinafter.

Figure 2:
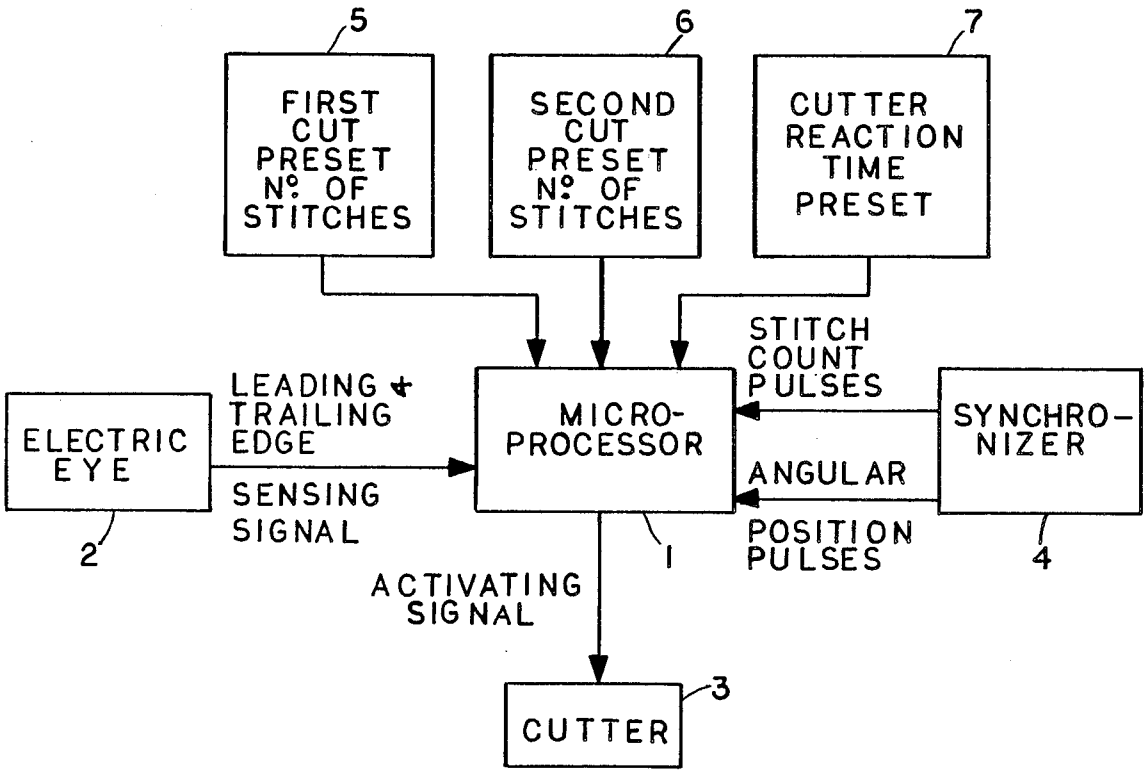
FIG. 2 is a block diagram of the system according to the present invention.
Figure 3:
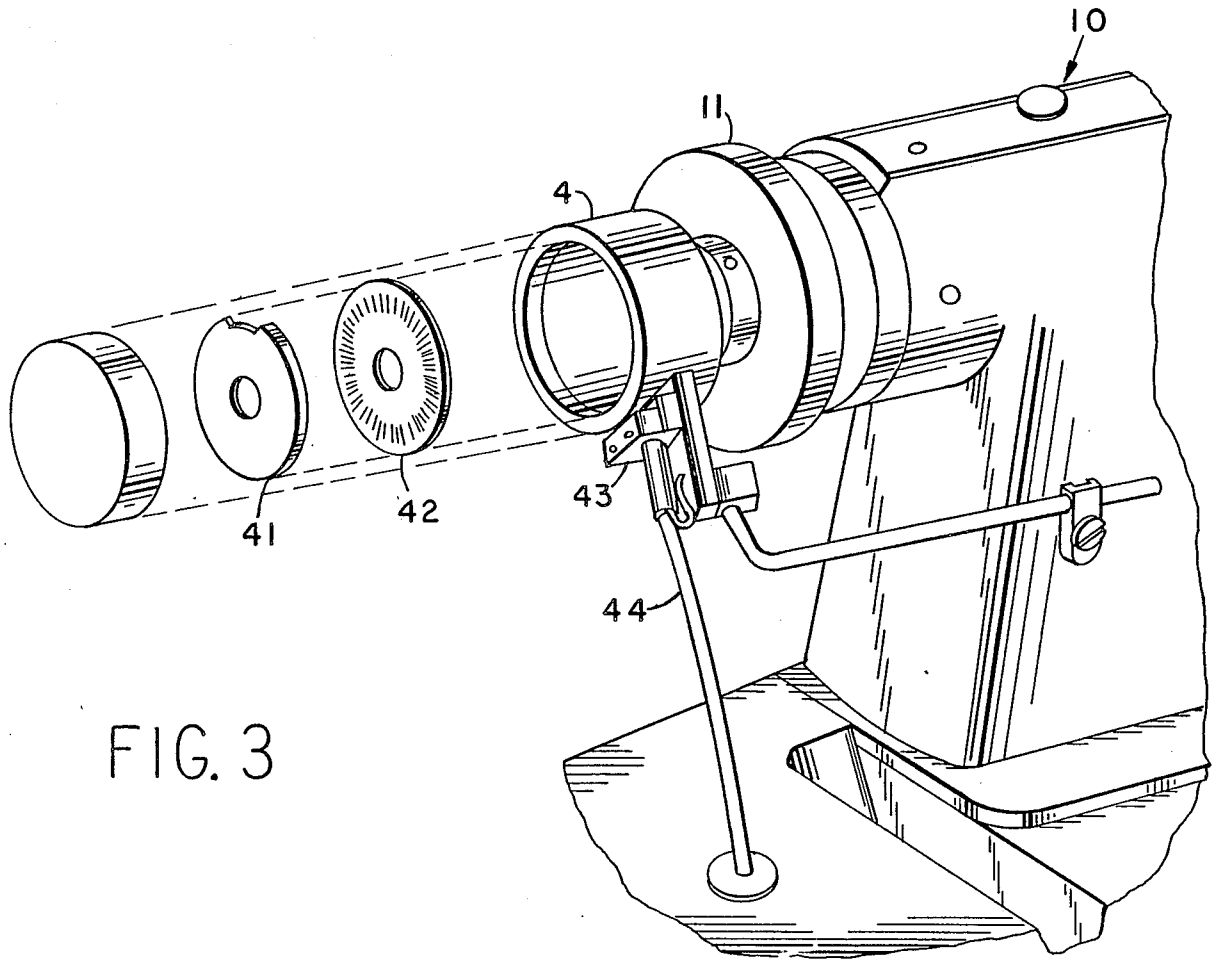
FIG. 3 is an exploded view of the synchronizer used in the system of FIG. 2.

As shown in FIG. 2, microprocessor 1 has an output connected to cutter 3 to activate the same and has a number of inputs from the synchronizer 4 and electric eye 2 as well as some preset inputs 5–7.

The electric eye 2 creates a pulse signal indicating the sensing of the edge of a material M, which either can be the leading or the trailing edge thereof. Input 5 is preferably a pair of thumbwheel switches which indicate a count from 0 to 99 of the number of stitches that will be present in the distance SE at the leading edge of the material. Input 6 corresponds to a second count preset and is preferably another pair of thumbwheel switches containing a count from 0 to 99 and indicating the preset number of stitches that occur in the distance SE at the trailing edge of the material. These separate inputs allow for a flush cut of both the leading and the trailing edges of the material M when the material M is not rectangular. For instance, if the leading edge was at right angles to a binding and trailing edge formed an angle with the binding, the number of stitches that would be applied from the time the leading and trailing edges of the material were sensed to when the leading edge or the trailing edge reached the cutter, would be different at the leading and trailing edges of the material. Also, for certain garment styles, flush cuts are not required. It is understood however, the present invention also comprehends a less flexible apparatus with a single input that would necessarily be the number of stitches applied in a distance SE at both the leading and the trailing edges of material M.

Input 7 compensates for the cutter reaction time of the cutter blade 31; that is, the time it takes from the time of actuation for the cutter blade to swing through its arc to cut the material. This time is translated into a number of stitches depending upon the speed of the sewing machine and can thus be easily calculated by the microprocessor 1.

Preset inputs 5 and 6 are set to obtain a flush cut at the beginning and the end of the material M when sewing at a slow or minimum speed. The number of stitches or preset count is equal to the distance SE between the electric eye and the cutter blade 31 divided by the stitch length. Assuming the machine is operated at low speed and the cutter reaction time is sufficiently fast, the cutter will be actuated after the preset number of stitches have been sewn. However, at higher speeds more stitches will be sewn during the cutter reaction time. As a result, it will be necessary to compute the number of stitches that will be sewn during the cutter reaction time and then subtract this number from the preset count. In other words, the cutter must be actuated earlier since the garment is moving through the machine at a faster rate.

The following describes the necessary computations during the first cut, at the leading edge of the material. The same analysis applies for the second cut, at the trailing edge of the garment. The microprocessor can compensate for increased speeds by measuring the number of pulses from the synchronizer disc 42 during a time that is proportional to cutter reaction time. Since the number of stitches (NS) sewn during this time is proportional to machine speed and the number of pulses generated by disc 42 (NP) is also proportional to machine speed then NS, the required number of compensation stitches, will be proportional to NP.

This count is subtracted from the preset count in preset input 5 or 6 in order to obtain the flush cut independent of sewing speed. The compensated count taking into account the reaction time is calculated as follows:

$$\text{COMPENSATED COUNT} = \text{PRESET COUNT} - RPS \times tc$$
$$= \text{PRESET COUNT} - tc/ts$$

where

RPS = Sewing machine speed (revolutions/sec.)
tc = Cutter reaction time (sec.)
ts = 1/RPS = Time per stitch (sec.)

This equation is solved directly by measuring the number of pulses generated by encoder disc 42 during the given time, $T_B$. If the time is made proportional to cutter reaction time (tc) then the number of compensation stitches will be proportional to the number of pulses generated during the time base. That is if:

$$np = T_B/tp$$

and $$ns = tc/ts$$

then if we set $$ns = np/K \text{ where K is a constant} \quad (1)$$

From the above:

$$tc/ts = T_B/K \times tp$$

where $T_B$ = Time base (sec)
np = Number of pulses generated during the time base
tp = Time per pulse (sec)
ns = Number of compensation stitches
tc = Cutter reaction time (sec)

since $$ts = 240\ tp$$

then from the above:

$$T_B = K \times tc/240$$

If we measure the number of pulses generated by encoder disc 42 during time $T_B$ then the number of compensation stitches (NS) will be equal to:

$$NS = NP/K$$

The higher the value of "K" the more accurate the solution because more pulses will be counted during the time base. A convenient number for "K" is 16 because it is very simple to multiply or divide numbers that are a power of 2 with a digital computer. In the preferred embodiment, the microprocessor, continually registers, during each revolution of the handwheel 11, the number of timing pulses, NP, generated by disc 42 for a discrete time interval $T_B$. When the leading or the trailing edge of material is sensed, the last value registered is used to calculate NS.

The microprocessor 1 determines a compensated count by subtracting the number of compensation stitches, ns from the preset count. As mentioned previously, the controller, which in the preferred embodiment is a microprocessor 1, counts the number of revolutions of the handwheel after the leading edge or the trailing edge is sensed. The cutting means are actuated when the counted number of revolutions is equal to the compensated count. In the preferred embodiment, the synchronizer 4 is used to provide a count of the number of revolutions.

When the retroreflective tape 22 is first covered or uncovered by material M, an initial number of timing pulses that are generated from disc 42 are counted until a first needle down pulse is generated. The microprocessor 1 then subtracts the initial pulses generated from the total number of openings on the disc 42. The sewing machine, thereafter, continues to sew until the total number of needle down pulses are equal to the compensated count. After this point, when the number of timing pulses received by the microprocessor 1 is equal to the difference between the total number of timing markings on the disc 42 and the previously mentioned initial number of timing pulses, the cutter is actuated. Thus, the actuation of the cutter takes place after the number of revolutions of the handwheel equals the compensated count. Since the time remaining for the sewing machine to complete the sewing of a binding or the application of a thread chain is equal to the cutter reaction time, the cutting of the thread or binding is always accomplished at the edge of the material. Moreover, since revolutions of the handwheel are used, rather than a stitch count, random cutting errors that are introduced due to needle position when the edge of the material is sensed are also eliminated.

An example of a computer program for carrying out the above on a microprocessor is as follows:

```
ADJUST   03CF
ALLOW    02CA
ALLSET   038A
ATNTCH   013E
ATREST   02A0
AUTO     0055
BKFLG    02D4
BP       0184
BYPASS   01B1
CHABRT   00B9
CHKDP1   00EF
CHKND    0373
CHKPDL   032A
CHKR1    023F
CHKSPD   03BC
CHKSTP   0200
CHKTIM   038B
CKAUTO   00C3
CKFLGS   0230
CLRBYT   0009
CLRFLG   02CE
COMP     0124
COMPO    01E3
COVNOT   0292
CUT      0356
CUT1     00A8
DBLUP    036A
DECDUN   00A6
DECIT    009F
DECR3    016F
DIV16    018F
EYEBNC   03C1
EYECK    004F
EYECLR   0100
EYECV    0381
EYEWAI   0070
FICH     037B
FINDIT   0222
FINTBL   031A
FLGSET   034B
FOWARD   0349
FSTSPD   0081
FULREV   0345
GETVLU   03D8
GOCOMP   0175
GONOT    00ED
GOTEDG   0248
HIT      00DE
HLOT     00D8
INAUTO   00F8
INMAN    00C6
INREV    033F
INT      0154
INTLOK   0013
INTRPT   0007
LHIT     00E2
LIMCHK   004D
LIMIT    0283
LOADR5   0179
LOSTIT   0147
LOT      00D4
LTFWRD   033C
LTREV    0341
MAIN     001C
MAXRUN   0063
MCNTRL   001E
MOVING   00E6
NEUTRL   0338
NOAUTO   0020
NODEC    0258
NOER3    01DE
NOER4    01CD
NOEYE    0022
NOISE    03CD
NOPS     0377
NOTCOV   0251
NOTFRT   019D
NOTIN    0152
OFFSET   0135
OLDPDL   016D
ONEMS    0371
OPEDL    006C
OUT      02CB
OUTNCH   0158
OUTPDL   03DF
PDLEYE   0068
POWRUP   0000
PRERUN   0074
PRESUB   01D5
PULSE    0393
R2GR4    01C1
R2MR4    01BB
R4GR2    01D0
RSTABL   0310
RDFLAG   02D7
RDIPS    039A
RET1     01F6
RET2     0262
RET3     034D
RUN      008B
RUNNO    0086
SETFLG   02D2
SEWEYE   00B2
SEWN1    0257
SEWR4    0171
SEWTAK   025C
STACK    03E4
STAKIT   03F4
START    000C
STOPIT   0273
STPED    0042
STPEDG   028A
STRT     0034
STRTT    027A
SUBIT    01D9
T.D.     034E
TACHI    0187
TIMER    02DB
TOLIMT   023A
TRACKR   002F
UPDATE   0162
USUAL    0133
```

```
0000                    ORG     000H

0000 27         POWRUP: CLR     A
0001 B83F               MOV     R0,#3FH
0003 0409               JMP     CLRBYT
0007                    ORG     007H
0007 44DB       INTRPT: JMP     TIMER
0009 A0         CLRBYT: MOV     @R0,A
000A E809               DJNZ    R0,CLRBYT
000C 65         START:  STOP    TCNT
000D 27                 CLR     A
000E 37                 CPL     A
000F 39                 OUTL    P1,A     ;COMMAND NEUTRAL
0010 3A                 OUTL    P2,A     ;OUTPUTS OFF
0011 A5                 CLR     F1
0012 85                 CLR     F0
0013 742A       INTLOK: CALL    CHKPDL
0015 37                 CPL     A
0016 9213               JB4     INTLOK   ;LOOP UNTIL NEUTRAL
0018 B92F               MOV     R1,#47
001A 744E               CALL    T.D.     ;JUST WAIT 200MS
001C 749A       MAIN:   CALL    RDIPS    ;A + R6 GET DIPSWITCH DATA
001E 5255       MCNTRL: JB2     AUTO     ;JUMP IF DIPSWITCH 2 IS ON
0020 3268       NOAUTO: JB1     PDLEYE   ;JUMP IF DIPSWITCH 1 IS ON
0022 742A       NOEYE:  CALL    CHKPDL
0024 37                 CPL     A
0025 F22F               JB7     TRACKR   ;JUMP IF PEDAL NOT FOWARD
0027 54D7               CALL    RDFLAG
0029 324D               JB1     LIMCHK   ;JUMP IF LIMIT FLAG IS SET
002B 74DF               CALL    OUTPDL   ;OUTPUT PEDAL VALUE
002D 044F               JMP     EYECK
002F 74DF       TRACKR: CALL    OUTPDL   ;OUTPUT PEDAL VALUE
0031 1631               JTF     $
0033 55                 STRT    T
0034 27         STRT:   CLR     A
0035 62                 MOV     T,A
0036 161C               JTF     MAIN     ;JUMP IF STOPPED
0038 3636               JTO     $-2      ;LOOP IF TACH HI
003A 161C               JTF     MAIN     ;JUMP IF STOPPED
003C 263A               JNTO    $-2      ;LOOP IF TACH LO
003E 5642               JT1     STPED    ;JUMP IF IN NOTCH
0040 A5                 CLR     F1
0041 85                 CLR     F0
0042 8646       STPED:  JNI     $+4      ;JUMP IF EYE IS COVERED
0044 0434               JMP     STRT
0046 23FC               MOV     A,#0FCH
0048 39                 OUTL    P1,A     ;COMMAND 1ST STEP SPEED
0049 5649               JT1     $
004B 048B               JMP     RUN
004D 54B3       LIMCHK: CALL    LIMIT
004F 8663       EYECK:  JNI     MAXRUN   ;JUMP IF EYE IS COVERED
0051 7493               CALL    PULSE
0053 0422               JMP     NOEYE    ;LOOP UNTIL EYE IS COVERED
0055 3259       AUTO:   JB1     $+4      ;JUMP IF DIP 1 IS ON
0057 041C               JMP     MAIN
0059 742A               CALL    CHKPDL
005B F270               JB7     EYEWAI   ;JUMP IF PEDAL FOWARD
005D 74C1               CALL    EYEBNC
005F C674               JZ      PRERUN   ;JUMP IF EYE IS COVERED
0061 046C               JMP     OPEDL
0063 FE         MAXRUN: MOV     A,R6
0064 1281               JB0     FSTSPD   ;JUMP IF TOGGLE IS UPPER
0066 048B               JMP     RUN
0068 742A       PDLEYE: CALL    CHKPDL
006A F270               JB7     EYEWAI   ;JUMP OF PEDAL IS FOWARD
006C 74DF       OPEDL:  CALL    OUTPDL
006E 041C               JMP     MAIN
0070 74C1       EYEWAI: CALL    EYEBNC   ;CHECK AND DEBOUNCE EYE
0072 9686               JNZ     RUNNO    ;JUMP IF NOT COVERED
0074 FE         PRERUN: MOV     A,R6
0075 1281               JB0     FSTSPD   ;JUMP IF TOGGLE WAS UPPER
```

```
0077 742A              CALL    CHKPDL
0079 F27D              JB7     $+4       ;JUMP IF PEDAL IS FOWARD
007B 046C              JMP     OPEDL
007D 74DF              CALL    OUTPDL
007F 048B              JMP     RUN
0081 23F4     FSTSPD:  MOV     A,#0F4H
0083 39                OUTL    P1,A
0084 048B              JMP     RUN
0086 23FE     RUNNO:   MOV     A,#0FEH
0088 39                OUTL    P1,A      ;COMMAND LT. FOWARD
0089 041C              JMP     MAIN      ;LOOP UNTIL PEDAL IS FOWARD
008B 7493     RUN:     CALL    PULSE     ; PULSE TO VENTURI
008D 2301              MOV     A,#00000001B
008F 54D2              CALL    SETFLG    ;SET 1ST CUT FLAG
0091 2301              MOV     A,#01
0093 74D8              CALL    GETVLU    ;A GETS "B" COUNT
0095 AB                MOV     R3,A      ;R3 GETS IT NOW
0096 27                CLR     A
0097 74D8              CALL    GETVLU    ;A GETS "A" COUNT
0099 74CF              CALL    ADJUST    ;R3 GETS "AB" BINARY COUNT
009B FB                MOV     A,R3
009C C6A8              JZ      CUT1      ;JUMP IF "AB" COUNT IS 0
009E F8                MOV     A,R0
009F C6A6     DECIT:   JZ      DECDUN
00A1 07                DEC     A
00A2 EB9F              DJNZ    R3,DECIT
00A4 04B2              JMP     SEWEYE
00A6 3424     DECDUN:  CALL    COMP
00A8 23FD     CUT1:    MOV     A,#11111101B
00AA 54CE              CALL    CLRFLG    ;CLEAR LIMIT FLAG
00AC FE                MOV     A,R6
00AD 37                CPL     A
00AE D2B2              JB6     SEWEYE    ;JUMP IF DIP 6 IS OFF
00B0 7456              CALL    CUT
00B2 742A     SEWEYE:  CALL    CHKPDL
00B4 37                CPL     A
00B5 D2C3              JB6     CKAUTO    ;JUMP IF NO HEEL 2
00B7 74DF              CALL    OUTPDL
00B9 742A     CHABRT:  CALL    CHKPDL
00BB F2C3              JB7     CKAUTO    ;JUMP IF PEDAL IF FOWARD
00BD 74DF              CALL    OUTPDL
00BF 86B9              JNI     CHABRT    ;JUMP IF EYE IS STILL COVERED
00C1 040C              JMP     START
00C3 FE       CKAUTO:  MOV     A,R6      ;A GETS DIPSWITCH DATA
00C4 12F8              JB0     INAUTO    ;JUMP IF TOGGLE WAS UPPER
00C6 74DF     INMAN:   CALL    OUTPDL    ;OUTPUT PEDAL VALUE
00C8 FF                MOV     A,R7
00C9 F2EF              JB7     CHKDP1    ;JUMP IF PEDAL FOWARD
00CB 86B2              JNI     SEWEYE    ;JUMP IF EYE IS COVERED
00CD 27                CLR     A
00CE 62                MOV     T,A
00CF 55                STRT    T
00D0 16D0              JTF     $
00D2 36DE              JT0     HIT       ;JUMP IF TACH IS HI
00D4 16ED     LOT:     JTF     GONOT     ;JUMP IF TIME IS UP
00D6 26D4              JNT0    LOT       ;LOOP IF TACH STAYS LO
00D8 16ED     HLOT:    JTF     GONOT     ;JUMP IF TIME IS UP
00DA 36D8              JT0     HLOT      ;LOOP IT TACH STAYS HI
00DC 04E6              JMP     MOVING
00DE 16ED     HIT:     JTF     GONOT     ;JUMP IF TIME IS UP
00E0 36DE              JT0     HIT       ;LOOP IF TACH STAYS HI
00E2 16ED     LHIT:    JTF     GONOT     ;JUMP IF TIME IS UP
00E4 26E2              JNT0    LHIT      ;LOOP IF TACH STAYS LO
00E6 23FC     MOVING:  MOV     A,#0FCH
00E8 39                OUTL    P1,A      ;COMMAND 1ST STEP SPEED
00E9 56E9              JT1     $         ;WAIT IF IN NOTCH
00EB 2400              JMP     EYECLR
00ED 040C     GONOT:   JMP     START
00EF FE       CHKDP1:  MOV     A,R6      ;A GETS DIPSWITCH DATA
00F0 72F4              JB3     $+4       ;JUMP IF DIP 3 IS OFF
00F2 7493              CALL    PULSE     ;PULSE VENTURI
```

```
00F4 86B2              JNI     SEWEYE  ;LOOP UNTIL EYE IS UNCOVERED
00F6 2400              JMP     EYECLR
00F8 23F4      INAUTO: MOV     A,#0F4H
00FA 39                OUTL    P1,A    ;COMMAND MAX SPEED'
00FB 04EF              JMP     CHKDP1


0100                   ORG     100H
0100 7493      EYECLR: CALL    PULSE
0102 23FE              MOV     A,#11111110B
0104 54CE              CALL    CLRFLG  ;CLEAR 1ST CUT FLAG
0106 2304              MOV     A,#04
0108 74D8              CALL    GETVLU
010A AB                MOV     R3,A    ;R3 GETS "F" COUNT
010B 2303              MOV     A,#03
010D 74D8              CALL    GETVLU  ;A GETS "E" COUNT
010F 74CF              CALL    ADJUST  ;R3 GETS "EF" BINARY SEWCOUNT
0111 B800              MOV     R0,#00
0113 3424              CALL    COMP
0115 FE                MOV     A,R6
0116 37                CPL     A
0117 F21B              JB7     $+4     ;JUMP IF DIP 7 IS ON
0119 7456              CALL    CUT
011B 74E4              CALL    STACK
011D FE                MOV     A,R6
011E 9222              JB4     $+4     ;JUMP IF DIP 4 IS ON
0120 041C              JMP     MAIN
0122 040C              JMP     START   ;THIS CYCLE IS DONE !!!!!!!!!!!

0124 FB        COMP:   MOV     A,R3
0125 C6F6              JZ      RET1    ;JUMP IF COUNT = 0
0127 2304              MOV     A,#00000100B
0129 54D2              CALL    SETFLG  ;SET 1ST PASS FLAG
012B 23F7              MOV     A,#11110111B
012D 54CE              CALL    CLRFLG  ;CLEAR STOPPED FLAG
012F 54D7              CALL    RDFLAG
0131 3247              JB1     LOSTIT  ;JUMP IF LIMIT FLAG IS SET
0133 BCF0      USUAL:  MOV     R4,#240
0135 563E      OFFSET: JT1     ATNTCH  ;JUMP IF IN NOTCH
0137 3637              JT0     $       ;WAIT IF TACH IS HI
0139 2639              JNT0    $       ;WAIT IF TACH IS LO
013B CC                DEC     R4
013C 2435              JMP     OFFSET
013E 4650      ATNTCH: JNT1    OUTNCH  ;JUMP IF OUT OF NOTCH
0140 3640              JT0     $
0142 2642              JNT0    $
0144 CC                DEC     R4
0145 243E              JMP     ATNTCH
0147 BC78      LOSTIT: MOV     R4,#120
0149 4652              JNT1    NOTIN
014B B64F              JB0     $+4
014D 2454              JMP     INT
014F 1B                INC     R3
0150 2454              JMP     INT
0152 4652      NOTIN:  JNT1    $       ;WAIT IF NOT IN NOTCH
0154 5654      INT:    JT1     $       ;WAIT IF IN NOTCH
0156 246D              JMP     OLDPDL
0158 FE        OUTNCH: MOV     A,R6
0159 125D              JB0     $+4     ;JUMP IF TOGGLE WAS UPPER
015B 2462              JMP     UPDATE
015D 23F4              MOV     A,#0F4H
015F 39                OUTL    P1,A    ;COMMAND MAX SPEED
0160 246D              JMP     OLDPDL
0162 09        UPDATE: IN      A,P1
0163 D267              JB6     $+4     ;JUMP IF PEDAL "C" BIT IS HI
0165 2469              JMP     $+4
0167 B26D              JB5     OLDPDL  ;JUMP IF PEDAL "B" BIT IS HI
0169 47                SWAP    A
016A 43F0              ORL     A,#0F0H
016C 39                OUTL    P1,A    ;COMMAND NEW PEDAL FOWARD VALUE
016D A5        OLDPDL: CLR     F1
```

```
016E 85                 CLR     F0
016F E875       DECR3:  DJNZ    R3,GOCOMP
0171 FC         SEWR4:  MOV     A,R4     ;A GETS TACHS BEFORE N.D
0172 AA                 MOV     R2,A     ;R2 HAS THEM NOW
0173 445C               JMP     SEWTAK
0175 2302       GOCOMP: MOV     A,#02
0177 74D8               CALL    GETVLU   ;A GETS "C" COUNT
0179 0310       LOADR5: ADD     A,#10H
017B E3                 MOVP3   A,@A     ;A GETS TIME BASE
017C 65                 STOP    TCNT
017D 62                 MOV     T,A      ;LOAD TIMER
017E 167E               JTF     $
0180 25                 EN      TCNTI
0181 27                 CLR     A
0182 3682               JT0     $        ;WAIT IF TACH IS HI
0184 2684               JNT0    $        ;WAIT IF TACH IS LO
0186 55                 STRT    T
0187 3687       TACHI:  JT0     $        ;WAIT IF TACH HI
0189 17                 INC     A
018A 268A               JNT0    $
018C 17                 INC     A
018D 2487               JMP     TACHI
018F FB         DIV16:  MOV     A,R3     ;A GETS REMAINING STITCHES
0190 A9                 MOV     R1,A     ;R1 HAS THEM NOW
0191 54D7               CALL    RDFLAG
0193 37                 CPL     A
0194 529D               JB2     NOTFRT   ;JUMP IF NOT FIRST PASS
0196 23FB               MOV     A,#11111011B
0198 54CE               CALL    CLRFLG   ;CLEAR 1ST PASS FLAG
019A FF                 MOV     A,R7
019B 24B1               JMP     BYPASS
019D D5         NOTFRT: SEL     RB1
019E F8                 MOV     A,R0     ;A GETS CP
019F 97                 CLR     C
01A0 67                 RRC     A
01A1 A8                 MOV     R0,A     ;'R0 GETS CP/2
01A2 C5                 SEL     RB0
01A3 FF                 MOV     A,R7     ;A GETS CC
01A4 D5                 SEL     RB1
01A5 37                 CPL     A
01A6 68                 ADD     A,R0
01A7 37                 CPL     A        ;A GETS CC-CP/2
01A8 A8                 MOV     R0,A     ;'R0 SAVES CC-CP/2
01A9 C5                 SEL     RB0
01AA FF                 MOV     A,R7     ;A GETS CC
01AB 97                 CLR     C
01AC 67                 RRC     A        ;A GETS CC/2
01AD D5                 SEL     RB1
01AE 68                 ADD     A,R0     ;A GETS CC-CP/2+CC/2
01AF C5                 SEL     RB0
01B0 2F                 XCH     A,R7     ;A GETS CC(NOW CP),R7 GETS NEW CC
01B1 D5         BYPASS: SEL     RB1
01B2 A8                 MOV     R0,A     ;'R0 GETS CP
01B3 C5                 SEL     RB0
01B4 FF         BP:     MOV     A,R7     ;A GETS CC
01B5 530F               ANL     A,#00001111B     ;MASK INTEGER PART
01B7 031A               ADD     A,#1AH   ;ADD PG3 OFFSET FROM LOC 00
01B9 E3                 MOVP3   A,@A     ;A GETS FRACTIONAL COMPENSATION
01BA AA                 MOV     R2,A     ;R2 HAS IT NOW
01BB 37         R2MR4:  CPL     A
01BC 97                 CLR     C
01BD 6C                 ADD     A,R4
01BE 37                 CPL     A        ;A=R2-R4
01BF F6D0               JC      R4GR2    ;JUMP IF R4>R2
01C1 AA         R2GR4:  MOV     R2,A     ;R2 GETS R2-R4
01C2 DC                 XRL     A,R4
01C3 C6D0               JZ      R4GR2    ;JUMP IF R2=R4
01C5 230F               MOV     A,#0FH   ;0FH IS 240 CPL
01C7 6A                 ADD     A,R2
01C8 37                 CPL     A        ;A=240-R2
01C9 AA                 MOV     R2,A     ;R2 GETS 240-R2
```

```
01CA F9                 MOV     A,R1
01CB C6F6               JZ      RET1
01CD C9         NOER4:  DEC     R1
01CE 24D5               JMP     PRESUB
01D0 FC         R4GR2:  MOV     A,R4    ;A GETS TACHS BEFORE N.D
01D1 37                 CPL     A
01D2 6A                 ADD     A,R2
01D3 37                 CPL     A       ;A=R4-R2
01D4 AA                 MOV     R2,A    ;R2 GETS R4-R2
01D5 FF         PRESUB: MOV     A,R7    ;A GETS TACHCNT
01D6 47                 SWAP    A       ;DIVIDE BY 16
01D7 530F               ANL     A,#00001111B    ;MASK FRACTIONAL PART
01D9 C6E3       SUBIT:  JZ      COMPO   ;JUMP IF INTEGER COMP IS 0
01DB 29                 XCH     A,R1    ;A GETS REMAINING STITCHES,R1 HOLDS CC
01DC C6F6               JZ      RET1
01DE 29         NOER3:  XCH     A,R1    ;A GETS COMP, R1 GETS REMAINING
01DF 07                 DEC     A       ;DEC INTEGER COMP
01E0 C9                 DEC     R1      ;DEC REMAINING COUNT
01E1 24D9               JMP     SUBIT   ;LOOP UNTIL COMPENSATION IS DONE
01E3 F9         COMPO:  MOV     A,R1
01E4 C6E8               JZ      $+4
01E6 4400               JMP     CHKSTP
01E8 FA                 MOV     A,R2
01E9 37                 CPL     A
01EA 97                 CLR     C
01EB 2F                 XCH     A,R7
01EC 67                 RRC     A
01ED 97                 CLR     C
01EE 2F                 XCH     A,R7
01EF 6F                 ADD     A,R7
01F0 37                 CPL     A       ;SUBTRACT R7 FROM R2
01F1 AA                 MOV     R2,A    ;R2 GETS R2-R7
01F2 F6F6               JC      RET1
01F4 445C               JMP     SEWTAK
01F6 83         RET1:   RET


0200                    ORG     200H

0200 5648       CHKSTP: JT1     GOTEDG
0202 A5                 CLR     F1
0203 85                 CLR     F0
0204 FE                 MOV     A,R6    ;A GETS DIPSWITCH DATA
0205 7209               JB3     $+4     ;JUMP IF DIP 3 IS ON
0207 7493               CALL    PULSE   ;PULSE VENTURI
0209 742A               CALL    CHKPDL
020B 37                 CPL     A
020C D210               JB6     $+4     ;JUMP IF HEEL 2 IS OFF
020E 040C               JMP     START
0210 FE                 MOV     A,R6
0211 1200               JB0     CHKSTP  ;JUMP IF TOGGLE WAS UPPER
0213 FF                 MOV     A,R7
0214 F218               JB7     $+4     ;JUMP IF PEDAL FOWARD
0216 443F               JMP     CHKR1   ;JUMP IF PEDAL NOT FOWARD
0218 D5                 SEL     RB1
0219 43F0               ORL     A,#0F0H
021B AF                 MOV     R7,A    ;R7 GETS PEDAL
021C 09                 IN      A,P1
021D 43F0               ORL     A,#0F0H
021F AA                 MOV     R2,A    ;R2 GETS COMMAND
0220 BCFF               MOV     R4,#0FFH
0222 1C         FINDIT: INC     R4
0223 FC                 MOV     A,R4
0224 E3                 MOVP3   A,@A    ;A GETS PEDAL CODE FROM TABLE
0225 DA                 XRL     A,R2    ;COMPARE WITH COMMAND
0226 C630               JZ      CKFLGS  ;JUMP IF COMMAND=TABLE
0228 FC                 MOV     A,R4
0229 E3                 MOVP3   A,@A
022A DF                 XRL     A,R7
```

```
022B 9622              JNZ     FINDIT  ;JUMP IF TABLE NOT EQUAL PEDAL
022D C5                SEL     RB0
022E 4400              JMP     CHKSTP
0230 54D7      CKFLGS: CALL    RDFLAG
0232 323A              JB1     TOLIMT  ;JUMP IF LIMIT FLAG IS SET
0234 723A              JB3     TOLIMT  ;JUMP IF STOPPED FLAG IS SET
0236 74DF              CALL    OUTPDL  ;OUTPUT PEDAL SPEED
0238 4400              JMP     CHKSTP
023A C5        TOLIMT: SEL     RB0
023B 5483              CALL    LIMIT
023D 4400              JMP     CHKSTP
023F F9        CHKR1:  MOV     A,R1
0240 07                DEC     A
0241 C600              JZ      CHKSTP
0243 07                DEC     A
0244 C600              JZ      CHKSTP
0246 4473              JMP     STOPIT
0248 5648      GOTEDG: JT1     $       ;WAIT UNTIL OUT OF NOTCH
024A 864E              JNI     $+4
024C 4451              JMP     NOTCOV
024E B651              JF0     NOTCOV  ;JUMP IF F0=1
0250 18                INC     R0
0251 7658      NOTCOV: JF1     NODEC
0253 E957              DJNZ    R1,$+4
0255 445C              JMP     SEWTAK
0257 C8        SEWN1:  DEC     R3
0258 A5        NODEC:  CLR     F1
0259 85                CLR     F0
025A 2475              JMP     GOCOMP
025C 365C      SEWTAK: JT0     $
025E 265E              JNT0    $
0260 EA63              DJNZ    R2,$+3
0262 83        RET2:   RET
0263 5669              JT1     $+6
0265 A5                CLR     F1
0266 85                CLR     F0
0267 445C              JMP     SEWTAK
0269 8669              JNI     $+4
026B 445C              JMP     SEWTAK
026D B65C              JF0     SEWTAK
026F 95                CPL     F0      ;F0=1
0270 18                INC     R0
0271 445C              JMP     SEWTAK

0273 89FF      STOPIT: ORL     P1,#0FFH        ;COMMAND NEUTRAL
0275 27                CLR     A
0276 62                MOV     T,A     ;RELOAD FOR 34MS
0277 55                STRT    T
0278 1678              JTF     $
027A 27        STRTT:  CLR     A
027B 62                MOV     T,A
027C 16A0              JTF     ATREST  ;JUMP IF STOPPED
027E 367C              JT0     $-2     ;LOOP IF TACH HI
0280 16A0              JTF     ATREST  ;JUMP IF STOPPED
0282 2680              JNT0    $-2     ;LOOP IF TACH LO
0284 568A              JT1     STPEDG  ;JUMP IF IN NOTCH
0286 A5                CLR     F1
0287 85                CLR     F0
0288 447A              JMP     STRTT
028A 868E      STPEDG: JNI     $+4     ;JUMP IF EYE IS COVERED
028C 4492              JMP     COVNOT
028E B692              JF0     COVNOT  ;JUMP IF F0=1
0290 95                CPL     F0      ;F0=1
0291 18                INC     R0
0292 767A      COVNOT: JF1     STRTT
0294 B5                CPL     F1
0295 ED7A              DJNZ    R3,STRTT
0297 230F              MOV     A,#15
0299 6C                ADD     A,R4
029A AC                MOV     R4,A
```

```
029B 23FC              MOV     A,#0FCH
029D 39                OUTL    P1,A
029E 2471              JMP     SEWR4
02A0 742A      ATREST: CALL    CHKPDL
02A2 37                CPL     A
02A3 D2A7              JB6     $+4      ;JUMP IF NO HEEL 2
02A5 040C              JMP     START
02A7 F2A0              JB7     ATREST   ;JUMP IF NO PEDAL FOWARD
02A9 230C              MOV     A,#00001100B
02AB 54D2              CALL    SETFLG   ;SET 1ST PASS AND STOPPED FLAGS
02AD 54B3              CALL    LIMIT
02AF 7493              CALL    PULSE    ;PULSE VENTURI
02B1 2475              JMP     GOCOMP

02B3 FF        LIMIT:  MOV     A,R7     ;A GETS PEDAL
02B4 43F0              ORL     A,#11110000B
02B6 D5                SEL     RB1
02B7 AF                MOV     R7,A     ;'R7 HOLDS PEDAL
02B8 230E              MOV     A,#0E
02BA AA                MOV     R2,A     ;R2 GETS # OF LOOPS
02BB E3                MOVP3   A,@A
02BC AB                MOV     R3,A     ;R3 HOLDS MAX ALLOWED SPEED
02BD 1A                INC     R2
02BE CA        CHKSPD: DEC     R2
02BF FA                MOV     A,R2
02C0 E3                MOVP3   A,@A     ;A GETS NEXT ALLOWABLE SPEED
02C1 DF                XRL     A,R7     ;COMPARE WITH PEDAL
02C2 C6CA              JZ      ALLOW    ;JUMP IF EQUAL
02C4 FA                MOV     A,R2
02C5 96BE              JNZ     CHKSPD   ;JUMP IF LAST SPEED NOT CHECKED
02C7 FB                MOV     A,R3     ;A GETS MAX ALLOWED SPEED
02C8 44CB              JMP     OUT
02CA FF        ALLOW:  MOV     A,R7
02CB 39        OUT:    OUTL    P1,A
02CC C5                SEL     RB0
02CD 83                RET

02CE D5        CLRFLG: SEL     RB1
02CF 5E                ANL     A,R6
02D0 44D4              JMP     BKFLG
02D2 D5        SETFLG: SEL     RB1
02D3 4E                ORL     A,R6
02D4 AE        BKFLG:  MOV     R6,A
02D5 C5                SEL     RB0
02D6 83                RET

02D7 D5        RDFLAG: SEL     RB1
02D8 FE                MOV     A,R6
02D9 C5                SEL     RB0
02DA 83                RET

02DB 65        TIMER:  STOP    TCNT
02DC 35                DIS     TCNTI
02DD AF                MOV     R7,A     ;R7 SAVES A
02DE C7                MOV     A,PSW
02DF 5307              ANL     A,#00000111B     ;MASK ALL BUT STACK PONTER
02E1 07                DEC     A
02E2 E7                RL      A
02E3 0308              ADD     A,#08
02E5 A9                MOV     R1,A     ;R1 POINTS RETURN ADRESS
02E6 B18F              MOV     @R1,#8FH
02E8 93                RETR
02E9

0300                   ORG     300H

0300 FC                DB      0FCH     ;SPEED 1
0301 FD                DB      0FDH
0302 F9                DB      0F9H
0303 F8                DB      0F8H
```

```
0304 FA                 DB      0FAH
0305 FB                 DB      0FBH
0306 F3                 DB      0F3H
0307 F2                 DB      0F2H
0308 F0                 DB      0F0H
0309 F1                 DB      0F1H
030A F5                 DB      0F5H
030B F4                 DB      0F4H
030C F4                 DB      0F4H
030D F4                 DB      0F4H
030E F4                 DB      0F4H
030F F4                 DB      0F4H
0310 F7         RSTABL: DB      247
0311 F5                 DB      245
0312 F3                 DB      243
0313 F1                 DB      241
0314 EF                 DB      239
0315 ED                 DB      237
0316 EB                 DB      235
0317 E9                 DB      233
0318 E7                 DB      231
0319 E5                 DB      229

031A 00         FINTBL: DB      00
031B 0F                 DB      15
031C 1E                 DB      30
031D 2D                 DB      45
031E 3C                 DB      60
031F 4B                 DB      75
0320 5A                 DB      90
0321 69                 DB      105
0322 78                 DB      120
0323 87                 DB      135
0324 96                 DB      150
0325 A5                 DB      165
0326 B4                 DB      180
0327 C3                 DB      195
0328 D2                 DB      210
0329 E1                 DB      225

032A 09         CHKPDL: IN      A,P1    ;READ PEDAL
032B 47                 SWAP    A       ;PEDAL VALUE NOW IN LOW NIBLE
032C 530F               ANL     A,#0FH  ;MASK GARBAGE
032E AF                 MOV     R7,A    ;R7 SAVES PDAL VALUE
032F 37                 CPL     A       ;NOW ACTIVE LOW
0330 5249               JB2     FOWARD  ;JUMP IF C=0
0332 3249               JB1     FOWARD  ;JUMP IF B=0
0334 723F               JB3     INREV   ;JUMP IF D=0
0336 123C               JB0     LTFWRD  ;JUMP IF A=0
0338 2310       NEUTRL: MOV     A,#00010000B    ;SET B4, NEUTRAL FLAG
033A 644B               JMP     FLGSET
033C 27         LTFWRD: CLR     A       ;CLEAR ALL FLAG FOR LT.FWD
033D 644B               JMP     FLGSET
033F 1245       INREV:  JB0     FULREV  ;JUMP IF D=0
0341 2320       LTREV:  MOV     A,#00100000B ;SET B5, HEEL 1 FLAG
0343 644B               JMP     FLGSET
0345 2347       FULREV: MOV     A,#01000111B ;SET HEEL 2 FLAG
0347 644C               JMP     FLGSET+1
0349 2380       FOWARD: MOV     A,#10000000B    ;SET B7 PEDAL FORWARD FLAG
034B 4F         FLGSET: ORL     A,R7
034C AF                 MOV     R7,A    ;R7 GETS FLAGS AND PEDAL VALUE
034D 83         RET3:   RET
034E 27         T.D.:   CLR     A
034F 07                 DEC     A
0350 00                 NOP
0351 964F               JNZ     T.D.+1  ;LOOP UNTIL A = 0
0353 E94E               DJNZ    R1,T.D. ;LOOP UNTIL R1=0
0355 83                 RET

0356 9AEF       CUT:    ANL     P2,#11101111B   ;CUTTER DOWN
```

```
0358 2305              MOV     A,#05H
035A 74D8              CALL    GETVLU  ;A GETS "D" COUNT
035C E7                RL      A
035D E7                RL      A
035E 53FC              ANL     A,#11111100B
0360 A9                MOV     R1,A    ;R1 GETS "D" * 4
0361 FE                MOV     A,R6
0362 B26A              JB5     DBLUP   ;JUMP IF DIP 5 IS ON
0364 2319              MOV     A,#25
0366 69                ADD     A,R1
0367 A9                MOV     R1,A    ;R1 GETS ("D" * 4)+25
0368 6471              JMP     ONEMS
036A F9        DBLUP:  MOV     A,R1
036B E7                RL      A
036C 53F8              ANL     A,#11111000B
036E 033C              ADD     A,#60
0370 A9                MOV     R1,A    ;R1 GETS ("D" * 6)+60
0371 2316      ONEMS:  MOV     A,#22
0373 567B      CHKND:  JT1     FICH    ;JUMP IF IN NOTCH
0375 A5                CLR     F1
0376 85                CLR     F0
0377 00        NOPS:   NOP
0378 00                NOP
0379 648B              JMP     CHKTIM
037B B677      FICH:   JF0     NOPS    ;JUMP IF F0 IS SET
037D 8681              JNI     EYECV   ;JUMP IF EYE IS COVERED
037F 648B              JMP     CHKTIM
0381 95        EYECV:  CPL     F0
0382 18                INC     R0
0383 D5                SEL     RB1
0384 2E                XCH     A,R6
0385 1289              JB0     $+4     ;JUMP IF 1ST CUT
0387 4302              ORL     A,#00000010B    ;SET LIMIT FLAG
0389 2E                XCH     A,R6
038A C5                SEL     RB0
038B 07        CHKTIM: DEC     A
038C 9673              JNZ     CHKND   ;THIS LOOP IS 11 MC ANY WAY THROUGH
038E E971              DJNZ    R1,ONEMS
0390 8A10              ORL     P2,#00010000B   ;CUTTER UP
0392 83                RET

0393 9ADF      PULSE:  ANL     P2,#0DFH
0395 00                NOP
0396 00                NOP
0397 8A20              ORL     P2,#20H ;RESET AIR PULSE
0399 83                RET

039A 27        RDIPS:  CLR     A
039B A9                MOV     R1,A
039C 37                CPL     A
039D 02                OUTL    BUS,A   ;BUS = FFH
039E 08                INS     A BUS   ;READ DIPSWITCHES
039F 37                CPL     A       ;DIPS NOW ACTIVE HI
03A0 47                SWAP    A       ;AUTOXXX7654
03A1 F7                RLC     A       ;AUTO XXX7654X
03A2 77                RR      A       ;AUTO XXXX7654
03A3 47                SWAP    A       ;AUTO 7654XXXX
03A4 77                RR      A       ;AUTO X7654XXX
03A5 F7                RLC     A       ;7654XXAUTO
03A6 53F1              ANL     A,#11110001B ;MASK GARBAGE
03A8 AE                MOV     R6,A    ;R6 GETS DIPS 7-4 + AUTO
03A9 2306              MOV     A,#06
03AB 02                OUTL    BUS,A
03AC 0A                IN      A,P2
03AD 52B0              JB2     $+3     ;JUMP IF DIP 1 IS OFF
03AF 19                INC     R1
03B0 32B4              JB1     $+4     ;JUMP IF DIP 2 IS OFF
03B2 19                INC     R1
03B3 19                INC     R1
03B4 12BA              JB0     ALLSET  ;JUMP IF DIP 3 IS OFF
03B6 19                INC     R1
```

```
03B7 19                 INC     R1
03B8 19                 INC     R1
03B9 19                 INC     R1
03BA F9         ALLSET: MOV     A,R1
03BB E7                 RL      A
03BC 530E               ANL     A,#00001110B
03BE 4E                 ORL     A,R6
03BF AE                 MOV     R6,A     ;A GETS ;7654321AUTO
03C0 83                 RET

03C1 B00A       EYEBNC: MOV     R4,#10   ;DEBOUNCE 4.3MS X [R4] TIMES
03C3 B901               MOV     R1,#01   ;SETUP FOR 4.3MS DELAY
03C5 744E               CALL    T.D.     ;JUST WAIT 4.3MS
03C7 86C3               JNI     $+4      ;JUMP IF EYE STILL COVERED
03C9 64CD               JMP     NOISE    ;FALSE ALARM
03CB ECC3               DJNZ    R4,EYEBNC+2  ;LOOP 10 TIMES
03CD FC         NOISE:  MOV     A,R4     ;IF EYE IS VALID A=0
03CE 83                 RET

03CF C64D       ADJUST: JZ      RET3     ;JUMP IF TENS=0
03D1 2B                 XCH     A,R3     ;A GETS UNITS, R3 GETS TENS
03D2 030A               ADD     A,#10    ;ADD TENS TO UNITS
03D4 2B                 XCH     A,R3     ;A GETS TENS, R3 GETS UNITS
03D5 07                 DEC     A        ;DEC TENS
03D6 64CF               JMP     ADJUST

03D8 02         GETVLU: OUTL    BUS,A    ;MUX ADRESS OUT
03D9 00                 NOP
03DA 0A                 IN      A,P2     ;READ MUX
03DB 37                 CPL     A        ;NOW ACTIVE HI
03DC 530F               ANL     A,#00001111B     ;MASK GARBAGE
03DE 83                 RET

03DF FF         OUTPDL: MOV     A,R7     ;A GETS PEDAL + FLAGS
03E0 43F0               ORL     A,#0F0H ;MASK FLAGS
03E2 39                 OUTL    P1,A     ;OUTPUT PEDAL VALUE
03E3 83                 RET

03E4 2306       STACK:  MOV     A,#06H
03E6 02                 OUTL    BUS,A    ;MUX ADRESS OUT
03E7 00                 NOP
03E8 0A                 IN      A,P2     ;READ MUX
03E9 72F4               JB3     STAKIT   ;JUMP IF DIP 8 IS OFF
03EB D5                 SEL     RB1
03EC FE                 MOV     A,R6     ;A GETS FLAGS
03ED F7                 RLC     A        ;CARRY GETS STACKER TOGGLE BIT
03EE A7                 CPL     C
03EF 67                 RRC     A
03F0 AE                 MOV     R6,A     ;R6.7 GETS IT BACK
03F1 C5                 SEL     RB0
03F2 F24D               JB7     RET3     ;JUMP IF NOT TIME TO STACK
03F4 9ABF       STAKIT: ANL     P2,#10111111B
03F6 00                 NOP
03F7 8A40               ORL     P2,#01000000B    ;TRIGGER STACKER
03F9 83                 RET


0000                    END
```

While a preferred embodiment of the invention has been shown and described, it will be apparent that numerous omissions, changes and additions may be made in such embodiment without departing from the spirit and scope of the present invention.

What is claimed is:

1. In a sewing machine having a reciprocatable needle for stitching material, sensing means for sensing the presence or absence of material, and a cutter spaced from said sensing means for effecting a cutting operation a predetermined time after receipt of a trigger signal, the improvement comprising:

cutter control means connected with said cutter, said cutter control means comprising:

triggering means connected to said sensing means for applying a triggering signal to said cutter a preselected period of time after operation of said sensing means; and speed detection means connected to said sewing machine for producing a signal proportional to the speed of the sewing machine upon operation of said sensing means and for producing additional signals proportional to the speed of the sewing machine at times after operation of said sensing means and until application of said triggering signal to said cutter;

said triggering means including compensation means connected to said speed detection means and responsive to the signal generated thereby for varying said preselected period of time in accordance with the speed of said machine as detected by said speed detection means.

2. The sewing machine as in claim 1, in which said sensing means comprises an electric eye system spaced downstream of said needle.

3. The sewing machine as in claim 1, in which said sewing machine further includes a drive shaft, and wherein said speed detection means comprises a pulse generator connected to said drive shaft for generating pulses proportional to the speed of rotation of said drive shaft.

4. The sewing machine as in claim 3, in which said pulse generator comprises a first disc for generating a plurality of pulses during a revolution of said drive shaft, and a second disc for generating a single pulse during a revolution of said drive shaft.

5. In a sewing machine having a reciprocatable needle for stitching material thereunder, a motor driven handwheel for reciprocating said needle, said sewing machine being operable to apply a stitch to the material during a single complete revolution of said handwheel, actuatable cutting means for cutting thread or material in the vicinity of said needle within a finite time interval after actuation, and means for controlling the actuation of said cutting means, wherein the improvement comprises:

said controlling means further comprising:

sensing means disposed a preselected distance from said cutting means for sensing an edge of said material, first reference means for producing a first signal indicating a desired number of stitches that can be applied within said preselected distance, second reference means for producing a second signal indicating said finite time interval, counting means responsive to said sensing means for counting the number of revolutions of said handwheel as measured from when said edge is sensed, stitch means for sensing the stitching speed of said needle and for producing a stitch signal indicating the stitching speed, when said edge is sensed and also after when said edge is sensed, until actuation of said cutting means, means for generating a compensation signal representing a compensated number of stitches that can be applied as a function of said stitching speed and said finite time interval, compensation difference means responsive to said first and said compensation signals, for subtracting said compensated number of stitches from said desired number of stitches, and actuation means, responsive to said counting means and said difference means, for actuating said cutting means when said counted number of revolutions is equal to said difference between said desired number of stitches and said compensated number of stitches.

6. The sewing machine according to claim 5 wherein said counting means includes:

a synchronizer including a photoelectric circuit having a photocell, a first disc connected to said handwheel and having a single notch that is oriented on said first disc so that it passes said photocell when said needle is in its lowermost position to generate a needle down pulse, and a second disc having a plurality of openings thereon, spaced around the 360° angle thereof, such that when one of said openings passes said photocell, a timing pulse is generated, initial count means connected to said photocell, for counting an initial number of timing pulses that are generated between the time said edge is sensed and a first of said needle down pulses is generated, needle down pulse counting means connected to said photocell, for counting the total number of needle down pulses that are generated after an edge is sensed, timing pulse counting means connected to said photocell, for counting the number of said timing pulses that are generated after each of said needle down pulses is generated, and timing pulse subtraction means, responsive to said initial count means, for subtracting said initial number of timing pulses from said total number of said plurality of openings, and wherein said actuation means is responsive to said timing pulse subtracting means, said compensation difference means and said needle down pulse counting means and said timing pulse counting means, and actuates said cutting means after said total number of needle down pulses generated after an edge is sensed equals the difference of said desired number of stitches and said compensated number of stitches and the total number of said timing pulses generated thereafter is equal to said difference between said total number of said openings and said initial timing pulses.

7. The sewing machine according to claim 2 wherein said compensation signal generation means is connected to said photocell and further includes:

registration means for continually registering the total number of timing pulses that are generated during a series of equal, discrete time intervals that are measured during each revolution of said handwheel, each of said discrete time intervals being equal to the product of a constant and said finite time interval divided by said total number of said openings, and wherein said compensation signal indicates the quotient of said total number of timing pulses last contained in said registration means, prior to the time said edge is sensed, and said constant.

* * * * *